US005571307A

United States Patent [19]

Sizov et al.

[11] Patent Number: 5,571,307

[45] Date of Patent: Nov. 5, 1996

[54] PROCESS AND DEVICE FOR BLOWING OXYGEN OVER METAL MELTS

[75] Inventors: Anatoly Sizov, St. Petersburg, U.S.S.R.; Horst-Dieter Schöler; Ulrich Meyer, both of Duisburg, Germany

[73] Assignee: Mannesmann Aktiengesellschaft, Düsseldorf, Germany

[21] Appl. No.: 360,742

[22] PCT Filed: Apr. 22, 1993

[86] PCT No.: PCT/DE93/00362

§ 371 Date: Feb. 10, 1995

§ 102(e) Date: Feb. 10, 1995

[87] PCT Pub. No.: WO94/00604

PCT Pub. Date: Jan. 6, 1994

[30] Foreign Application Priority Data

Jun. 26, 1992 [DE] Germany ..... 42 21 266.9

[51] Int. Cl.[6] ..... C21C 5/46

[52] U.S. Cl. ..... 75/512; 75/511; 266/225

[58] Field of Search ..... 266/225, 226, 266/265; 75/511, 512

[56] References Cited

U.S. PATENT DOCUMENTS 4,057,421 11/1977 Fukui et al. ..... 75/512
4,746,103 5/1988 Takashiba et al. ..... 266/225
4,979,983 12/1990 Nishikawa et al. ..... 75/512

FOREIGN PATENT DOCUMENTS

0081448B1 6/1983 European Pat. Off. .
2709234B1 6/1978 Germany .

*Primary Examiner*—Scott Kastler
*Attorney, Agent, or Firm*—Cohen, Pontani, Lieberman, Pavane

[57] ABSTRACT

The invention relates to a process and a device for blowing oxygen over a metal melt under a vacuum. The oxygen is to be applied over a large surface with a large intermediate phase area while avoiding overcooling in the metal bath by simple, easily maintained structural means. The flow of oxygen in the lance is accelerated and compressed into plug-shaped oxygen pulses, which leave the lance in succession and which form an oxygen bell over the vacuum above the metal melt, having an oxygen casing and an oxygen core, the core moving at a speed similar to that of the casing. At the base of the wall 41 of the blowing lance 40 there is an annular nozzle 42. At a distance behind the annular nozzle 42 in the direction of flow of the oxygen there is a blind tube 44 forming a fan-shaped compartment 43. Between the bottom 46 of the blind tube 44 and the head of the blowing lance 40 there is a pre-nozzle chamber 48 and in the head of the blowing lance 40 there is at least one base nozzle 50 directed toward the melt. The head nozzle 50 takes the form of a Laval nozzle and has components 51 to stabilize the flow of oxygen.

11 Claims, 3 Drawing Sheets

PROCESS AND DEVICE FOR BLOWING OXYGEN OVER METAL MELTS

BACKGROUND OF THE INVENTION

1. Field of the Invention

In the production of steel, it is known to expose the metal melt contained in ladles, electric arc furnaces or converters to a vacuum and to use a lance to blow oxygen over the metal surface. The CO partial pressure reduction under vacuum allows decarbonization of high-alloy melts down to the lowest carbon content with simultaneous high chrome yield and without over-oxidations. Maximization of the bath surface along with obtaining the largest possible reaction space in a container are primary objects to achieve a high rate of carbon drop when oxygen is blown, even at high initial carbon contents.

2. Description of the Related Art

Typically the use of a lance to blow oxygen on to a metal melt results in an oxygen jet impinging relatively hard upon a bath surface. Influencing the blown steel may be accomplished by altering the number of blowing nozzles; altering the flow direction of the blowing nozzles; or having the oxygen jet emerge in pulses.

For example, DE-AS 27 09 234 discloses a device for blowing crude iron to steel in an oxygen blowing converter. Control valves within the device can be alternately activated by devices that provide for pulsation of the oxygen jet. However, this reference does not disclose a method of blowing-in oxygen under a vacuum. The primary disadvantage associated with the disclosed blowing arrangement is the use of a separately controlled fluidics control system.

EP 0 081 448 B1 discloses a process and a device for oxidizing a steel bath with an oxygen blowing lance. Use of the lance results in an oxygen jet impinging upon the bath surface at a speed within ultrasonic range. Overall oxygen flow is thereby divided into a hard and a soft jet. Furthermore, the disclosed metal bath operates in an environment with atmospheric pressure.

The disclosed blowing device creates an oxygen jet that impinges upon the surface of the steel bath in a relatively limited area, forming a deep erosion in the bath, and dispersing metal droplets into the gas space above the melt. Further, the oxygen jet cannot be adequately stabilized, thus causing the hard jet to drift within the overall flow.

SUMMARY OF THE INVENTION

It is an object of the present invention to provide a process and an apparatus for blowing oxygen through a lance over a metal melt under vacuum using simple and easily-maintained structural means to bring the oxygen into the metal bath over a large surface with a large intermediate phase area while avoiding over-oxidations.

The oxygen flow within the lance is accelerated and compressed and is pulsed. The oxygen emerges from the lance in plug shaped successions at ultrasonic speed. Each plug comprises an oxygen core and an oxygen casing surrounding the core. The oxygen casing spreads out into the vacuum essentially parallel to the axis of the lance and laterally above the melt in a bell-shaped form. Before impinging upon the melt, the oxygen core and the oxygen casing move at a speed relative to one another in the following relationship:

$$\frac{\rho_z \cdot v_z^2}{\rho_p \cdot v_p^2} = 0.4 \text{ to } 4.0,$$

wherein $\rho_z$ is the density of the oxygen core; $\rho_p$ is the density of the oxygen casing; $v_z$ is the speed of the oxygen core; $v_p$ is the speed of the oxygen casing. The relationship between the pressure of the oxygen in the lance ($p_O$) and the pressure in the chamber ($p_K$) is in the ranges of $p_O/p_K$=40 to 1,100 or $p_O/p_K$=1.100 to 4,500.

The relationship between the speed of the pressure wave (½ $v^2$) and the pressure of the oxygen in the lance ($p_O$) is in the range of $$\frac{\rho \cdot v^2}{2\,p_0} = 0.001 \text{ to } 0.65.$$

The lance includes a wall which defines an interior opening. An abrasion-free annular nozzle is disposed in the opening interior in the base region of the lance. Further, an abrasion-free blind pipe, having an open top and a closed bottom, is disposed within the interior opening. The space between the annular nozzle and the top of the blind pipe defines an oxygen fan-forming compartment. The space between the bottom of the blind pipe and the head of the lance defines a pre-nozzle chamber. The wall at the head of the lance includes a head nozzle which defines a controllable opening. This head nozzle points towards the metal melt and is formed as a Laval-shaped nozzle including a stabilizing component.

According to the invention, the oxygen flow enters the lance at the base region and is accelerated by flowing through the annular nozzle, forming plugs. A portion of the accelerated and compressed oxygen (the oxygen core) flows into the blind pipe, fills the blind pipe and collides with the closed end of the blind pipe. The other portion (the oxygen casing) travels along the outside of the blind pipe. After the collision at the bottom of the blind pipe, the oxygen core returns to the top of the blind pipe where it collides with the newly entering oxygen from the annular nozzle. The collision causes the formation of an oxygen fan. This oxygen fan blocks off the newly in-flowing oxygen from the annular nozzle for as long as the fan is active, that is, for as long as it take for the oxygen core to exit the blind pipe. The momentary blocking causes the formation of the pulsing plug-shaped successions of oxygen. After the collapse of the fan, the process just described starts again.

The oxygen casing separated from the oxygen plug, flows within the lance past the blind pipe, thus forming a torus, to the head of the lance into a pre-nozzle chamber, in which the oxygen torus is formed into a toroidal plug, which leaves the lance at ultrasonic speed via a head nozzle. By means of the design of the head nozzle, influence is exercised on the plug, by dividing the plug into an oxygen core and an oxygen casings surrounding the core.

When the oxygen casing spreads into the vacuum, it forms an oxygen bell. This bell produces in the melt a stable system of toroidal whirling with high intensity, which is not destroyed at the pressure curve above the melt bath surface. The oxygen jets penetrate deep into the melt, whereby, compared to other systems, a high radiation penetration depth is achieved in the melt. In the depressions, an intentional drop formation is caused. In addition, in the melt bath, a system of longitudinal and cross waves is created. The depressions themselves have a parabolic form.

The Laval-shaped nozzles provided at the head of the lance have a stabilizing component, which influences the position of the oxygen core as well as the shape of the oxygen casing.

In accordance with another embodiment, the annular nozzle may include a displacement body, which positively influences the oxygen volume flowing into the blind pipe.

DETAILED DESCRIPTION OF THE PREFERRED EMBODIMENTS

Figure 1:
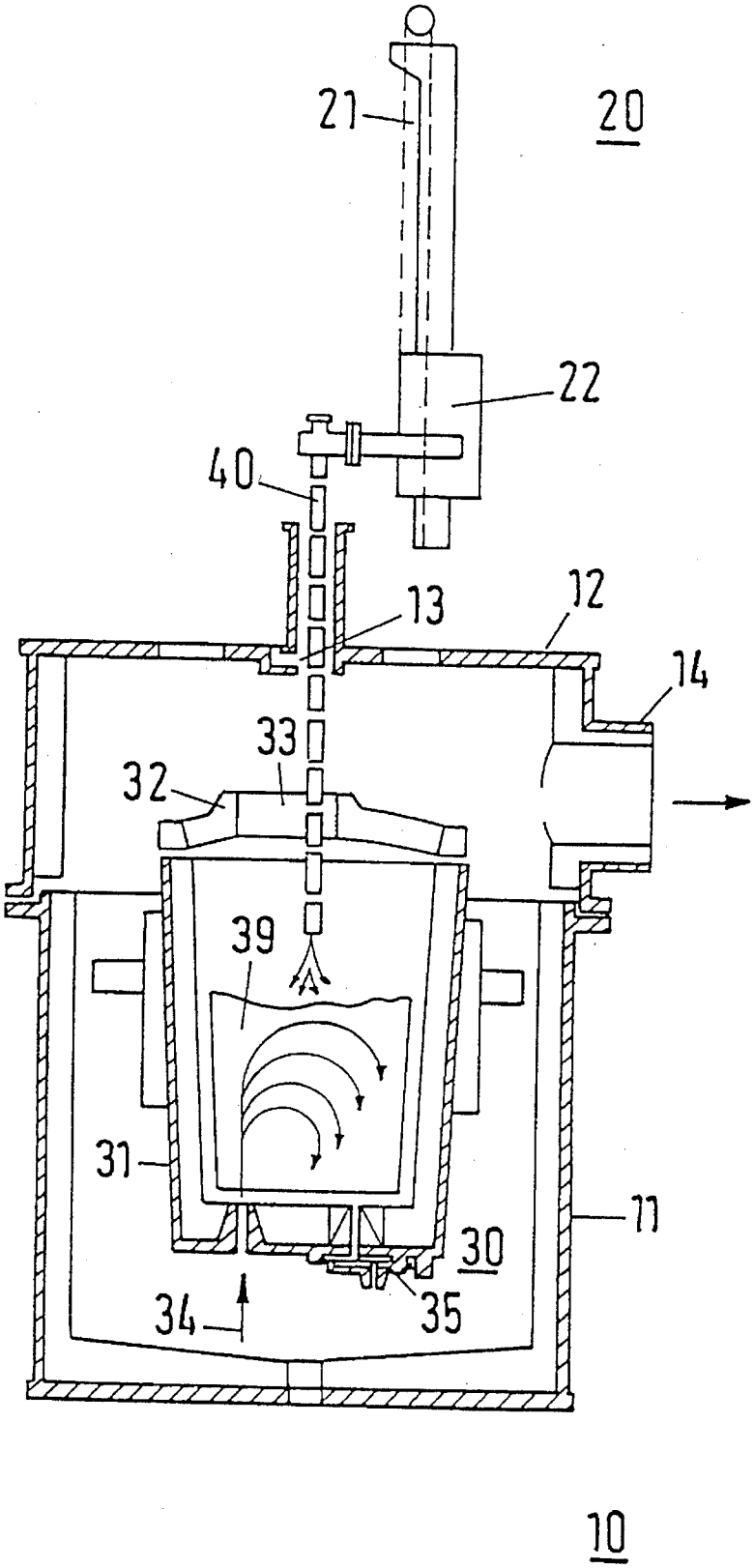
FIG. 1 illustrates an overview of the arrangement utilizing the blowing lance of the present invention.

FIG. 1 shows a vacuum stand 10 with a vacuum container 11, covered with vacuum hood 12. The vacuum hood 12 has a connection 14 to a vacuum unit not shown. The blowing lance 40 can be guided through passageway 13 to the ladle 30 kept in the vacuum state.

The blowing lance 40 is attached to a sliding carriage 22, which is movably arranged on a frame 21 of a lance device 20.

The ladle 30 has a vessel 31, which can be closed by a cover 32. The cover 32 has an opening 33, through which the blowing lance 40 is guided.

On the bottom of the vessel 31 is a purging device 34 and a seal 35 for closing off a tap hole. In the vessel, having an axis J is the metal melt 39.

Figure 2:
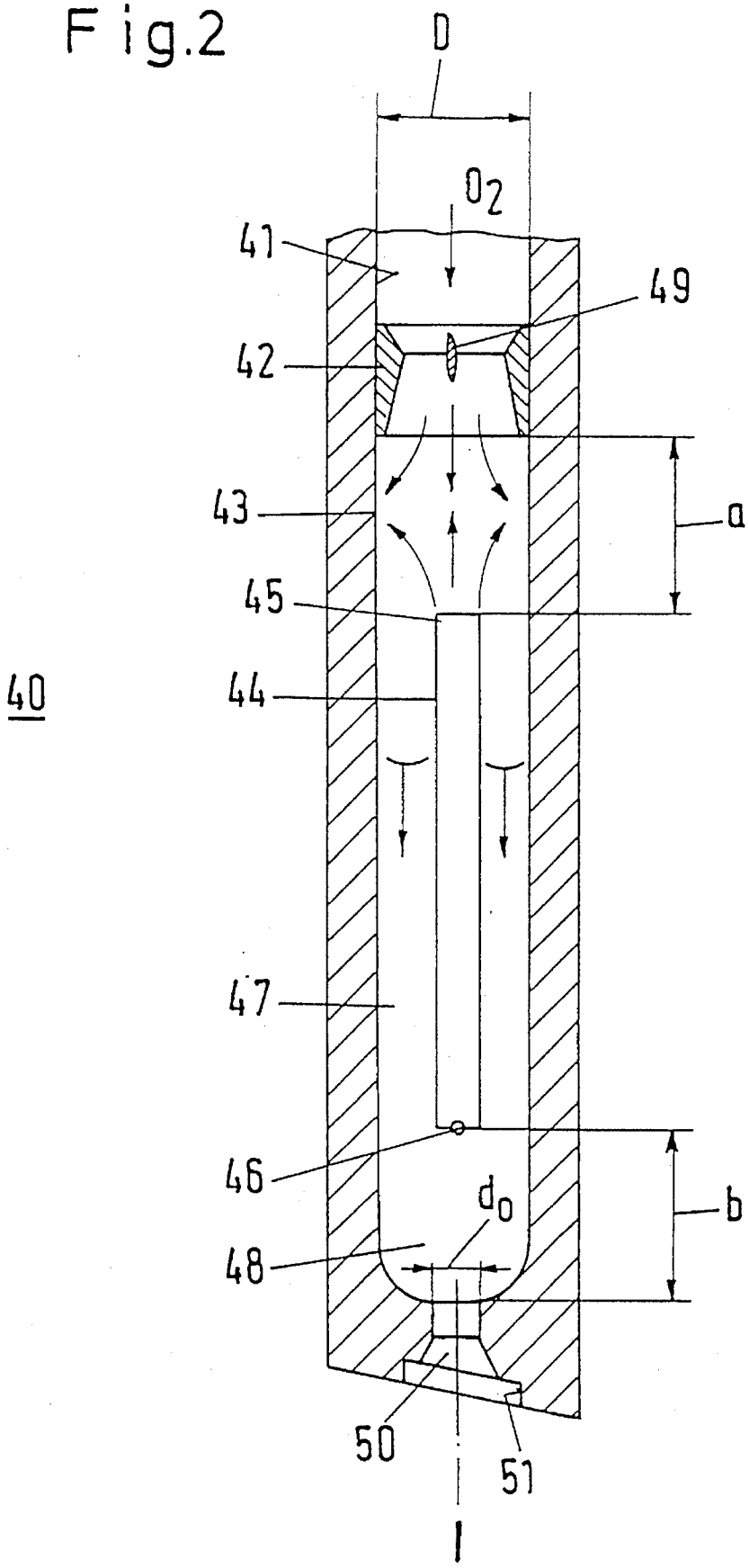
FIG. 2 illustrates a cross-section of a blowing lance according to the invention.

FIG. 2 shows the blowing lance 40 including a round wall 41, defining the opening D. An annular nozzle 42 is disposed in the base region. Head nozzle 50 is disposed in the head region of the blowing lance 40.

Between the annular nozzle 42 and the head nozzle 50, a blind pipe 44 is disposed along the central axis I of he lance, having an open top end 45 adjacent to the annular nozzle 42 and the bottom end 46 adjacent to the nozzle 50.

Between the open top end 45 of the blind pipe and the annular nozzle 42 there is a fan-forming compartment 43. Between the closed bottom end 46 of the blind pipe and the head nozzle 50 there is a pre-nozzle chamber 48. The fan-forming compartment 43 and the pre-nozzle chamber 48 are connected via an annular channel 47.

The head nozzle 50 includes a stabilizing component 51. In the center of the annular nozzle 42 there is a displacement body 49.

The diameter of the interior opening of the wall 41 is indicated by "D," the distance between the annular nozzle 42 and the open top end 45 of the blind pipe 44 by "a," the length of the pre-nozzle chamber 48 by "b," and the head nozzle diameter at its narrowest cross-section by "$d_0$." In a preferred embodiment, the distance a from the annular nozzle 42 to the top end 45 of the blind pipe relates to the inner diameter D at the opening surrounded by the wall 41 of the lance substantially as follows: a/D=0.3 to 0.8. Further, the length b of the pre-nozzle chamber 48 which is the distance from the bottom end of the blind pipe to the head nozzle 50, relates to the inner diameter D of the opening surrounded by the wall substantially as follows: b/D=0.8 to 1.3.

Figure 3:
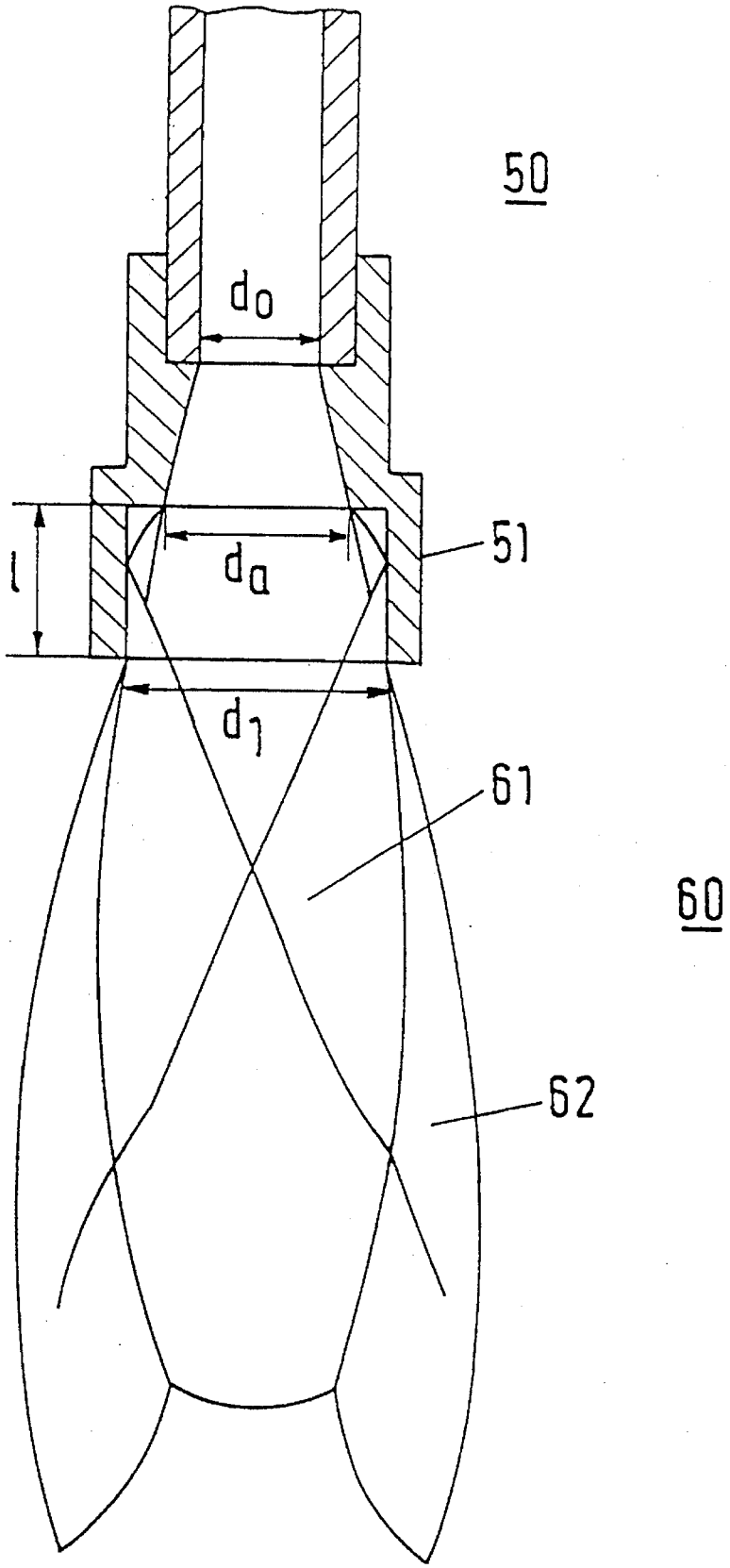
FIG. 3 illustrates a cross-section of a head nozzle with stabilizing component of the blowing lance according to the invention.

FIG. 3 shows a Laval-shaped head nozzle 50. At its narrowest cross-section, it includes a diameter $d_0$ and at the nozzle exit a cross-section $d_a$. The Laval-shaped nozzle 50 is connected to a stabilizing component 51. The stabilizing component 51 has the form of a pipe-shaped collar with an inner diameter $d_i$ and a length l.

Furthermore, an oxygen flow 60 is shown, including a core 61 and a casing 62 which surrounds the core.

We claim:

1. A process for blowing oxygen with a lance over a metal melt in a vessel exposed to a vacuum, comprising the steps of:

(a) providing oxygen flow into a lance;

(b) converting within the lance the oxygen flow into accelerated compressed plug-shaped pulsed successions of oxygen;

(c) controllably providing an exit for the plug-shaped pulsed successions of oxygen from the lance at ultrasonic speed so as to separate each plug-shaped succession of oxygen into an oxygen core and an oxygen casing surrounding the oxygen core;

(d) controllably providing the oxygen casing to expand in the vacuum above the metal melt so as to form a bell above the melt;

(e) providing a speed relationship between the oxygen core and the oxygen casing before impinging upon the melt, of $$\frac{\rho_z \cdot v_z^2}{\rho_p \cdot v_p^2} = 0.4 \text{ to } 4.0,$$

wherein $\rho_z$ is the density of the oxygen core, $\rho_p$ is the density of the oxygen casing, $v_z$ is the speed of the oxygen core and $v_p$ is the speed of the oxygen casing; and wherein a pressure relationship between the oxygen pressure in the lance ($p_O$) and the pressure in the vacuum container ($p_K$) is in the range of $p_O/p_K$=40 to 4,500; and a relationship between the speed of a pressure wave (½ $v^2$) and the oxygen pressure in the lance ($P_O$) is in the range of $$\frac{\rho \cdot v^2}{2 p_0} = 0{,}001 \text{ to } 0{,}65.$$

2. The process of claim 1, wherein the range of $p_O/p_K$=40 to 1,100.

3. The process of claim 1, wherein the range of $p_O/p_K$= 1,100 to 4,500.

4. The process of claim 1, further comprising the step of controllably impinging the oxygen core and the oxygen casing upon the metal melt at an adjustable angle of 0° to 30° to the axis of the vessel.

5. A lance for blowing oxygen on a metal melt in a vessel contained under vacuum, comprising:

(a) a circular wall defining a cylindrical opening (D), the circular wall including a closed-off base region and an open head region for accepting an oxygen flow;

(b) an annular nozzle disposed within the cylindrical opening, the annular nozzle being formed such as to accelerate the oxygen flow;

(c) a blind pipe being disposed within the cylindrical opening spaced by a distance (a) from the annular nozzle, the distance (a) defines an oxygen-fan-forming area, and the blind pipe having an opening at a first end directed towards the annular nozzle and for accepting the oxygen flow, a bottom at a second end for reflecting the oxygen flow back into the oxygen-fan-forming area; and (d) a Laval-shaped base nozzle disposed in the closed-off base region of the circular wall and spaced by a distance (b), from the bottom of the second end of the blind pipe, for blowing oxygen on the metal melt.

6. The lance of claim 5, wherein the annular nozzle is a Laval-shaped nozzle.

7. The lance of claim 6, further comprising a displacement body being disposed in the center of the Laval-shaped nozzle.

8. The lance of claim 5, wherein the ratio of the distance (a) to the cylindrical opening (D) substantially equals 0.3 to 0.8.

9. The lance of claim 5, wherein the ratio of the distance (b) to the cylindrical opening (D) substantially equals 0.8 to 1.3.

10. The lance of claim 5, further comprising a stabilizing component disposed on the Laval-shaped/head nozzle defined by an inner diameter ($d_i$) and a length (l).

11. The lance of claim 9, wherein a Laval-shaped nozzle defines an exit diameter ($d_a$); and wherein the ratio of the diameter ($d_i$) to the diameter ($d_a$) substantially equals 1.06 to 1.04 and the ratio of the length (l) to the diameter ($d_a$) substantially equals 0.3 to 1.9.

* * * * *